US011203002B1

(12) United States Patent
Lanclos et al.

(10) Patent No.: US 11,203,002 B1
(45) Date of Patent: Dec. 21, 2021

(54) AIRBORNE DUST MITIGATION SYSTEM

(71) Applicants: Christopher P. Lanclos, Kemah, TX (US); Hunter Whatley, Kemah, TX (US)

(72) Inventors: Christopher P. Lanclos, Kemah, TX (US); Hunter Whatley, Kemah, TX (US)

(73) Assignee: Refractory Construction Services Co. LLC, Deer Park, TX (US)

( * ) Notice: Subject to any disclaimer, the term of this patent is extended or adjusted under 35 U.S.C. 154(b) by 0 days.

(21) Appl. No.: 16/453,543

(22) Filed: Jun. 26, 2019

Related U.S. Application Data

(63) Continuation-in-part of application No. 16/380,495, filed on Apr. 19, 2019.

(51) Int. Cl.
*B01F 15/00* (2006.01)

(52) U.S. Cl.
CPC .. *B01F 15/00987* (2013.01); *B01F 15/00974* (2013.01); *B01F 2215/0047* (2013.01)

(58) Field of Classification Search
CPC ..... B01F 15/00987; B01F 15/00947; B01F 2215/0047
See application file for complete search history.

(56) References Cited

U.S. PATENT DOCUMENTS 4,062,274 A * 12/1977 Knab ..... B08B 15/02 454/65
4,670,936 A * 6/1987 Hanson ..... A21C 9/00 15/309.2
5,099,542 A * 3/1992 Fryc ..... B08B 5/023 15/306.1
6,491,070 B1 * 12/2002 Frutos ..... B01D 45/00 141/285
2008/0146133 A1 * 6/2008 Behrens ..... F24C 15/20 454/49

* cited by examiner

*Primary Examiner* — Anshu Bhatia
(74) *Attorney, Agent, or Firm* — Bushman Werner, P.C.

(57) ABSTRACT

A system for capturing airborne particles from a mixing apparatus for mixing mineral based building materials, particularly such materials containing a silica based material, wherein there is a hood assembly attachable to a mixing apparatus and positionable such that airborne particles generated in loading the mixing apparatus are drawn into the hood, the hood being operatively connectable to a vacuum/filtration apparatus.

6 Claims, 6 Drawing Sheets

AIRBORNE DUST MITIGATION SYSTEM

CROSS REFERENCE TO RELATED APPLICATION

This application is a continuation-in-part of U.S. application Ser. No. 16/380,495 filed on Apr. 10, 2019 the disclosure of which is incorporated herein by reference for all purposes.

FIELD OF THE INVENTION

The present invention relates to mitigation of airborne dust and, more particularly, to such dust generated by silica-containing building materials.

BACKGROUND OF THE INVENTION

Silica-containing powders, particulates and the like are considered by OSHA to be quite harmful when inhaled. Accordingly, in operations where silica-containing building materials are being prepared, precautions must be taken to reduce the amount of airborne silica dust. There are a variety of mineral-based building materials used in numerous different building applications. Many of these mineral-based building materials, e.g., concrete, mortar, grout, refractory, etc. do or can contain a silica or silica-type material. Depending on the composition being prepared, e.g., mortar, grout, etc. different types of mixers are employed. However, whatever the type of mixer, they have certain common features, namely, a mixing chamber or box having an entrance, a grate over the entrance, suitable mixing paddles, vanes, scrolls, or the like in the mixing box, the mixing paddles, vanes, etc., being driven by a motor connected in a well known fashion.

A common feature of these various mixers is the ingredients to be mixed are introduced into the entrance of the mixing chamber from bags although some are shoveled in, etc. Particularly in the case of bags of the material to be mixed, there are cutting elements connected to the grates which tear the bags as they are thrown or lifted onto the grate, the bag then being pulled apart and the ingredients falling through the grate into the mixing chamber. It will be readily apparent that this action can generate a significant amount of airborne particles of material. Likewise the use of a shovel to "throw" the building material ingredients into the mixing chamber through the grate also generates a significant amount of dust.

SUMMARY OF THE INVENTION

In one aspect, the present invention relates to a dust mitigation system for use with mixers used to mix mineral based materials for building purposes.

In another aspect, the present invention relates to mixers for mixing mineral based materials into end products such as mortar, grout, masonry, refractory etc.

These and further features and advantages of the present invention will become apparent from the following detailed description, wherein reference is made to the figures in the accompanying drawings.

DETAILED DESCRIPTION OF PREFERRED EMBODIMENTS

As used herein, the term "hood" shall mean and include an enclosure or canopy provided with a draft for carrying off fumes, sprays, smoke, or dust.

The term "adjacent" as used herein and with reference to the relationship of the hood/plenum assembly with a mixing chamber of any of the mixers is intended to mean that the hood/plenum of the hood/plenum assembly are attached to the mixers and positioned such that when the hood/plenum assembly is under suction, and the material to be mixed is being introduced into the mixing chamber through the entrance of the mixing chamber, any airborne dust generated will be drawn into the hood/plenum assembly preferentially as opposed to being released to the ambient surrounding the mixer. In other words, the proximity of the hood/plenum assembly to the mixing chamber will be such that the driving force of any airborne dust generated during the loading of the mixing chamber will be into the hood/plenum assembly and ultimately through the suction/ventilation system.

Figure 1:
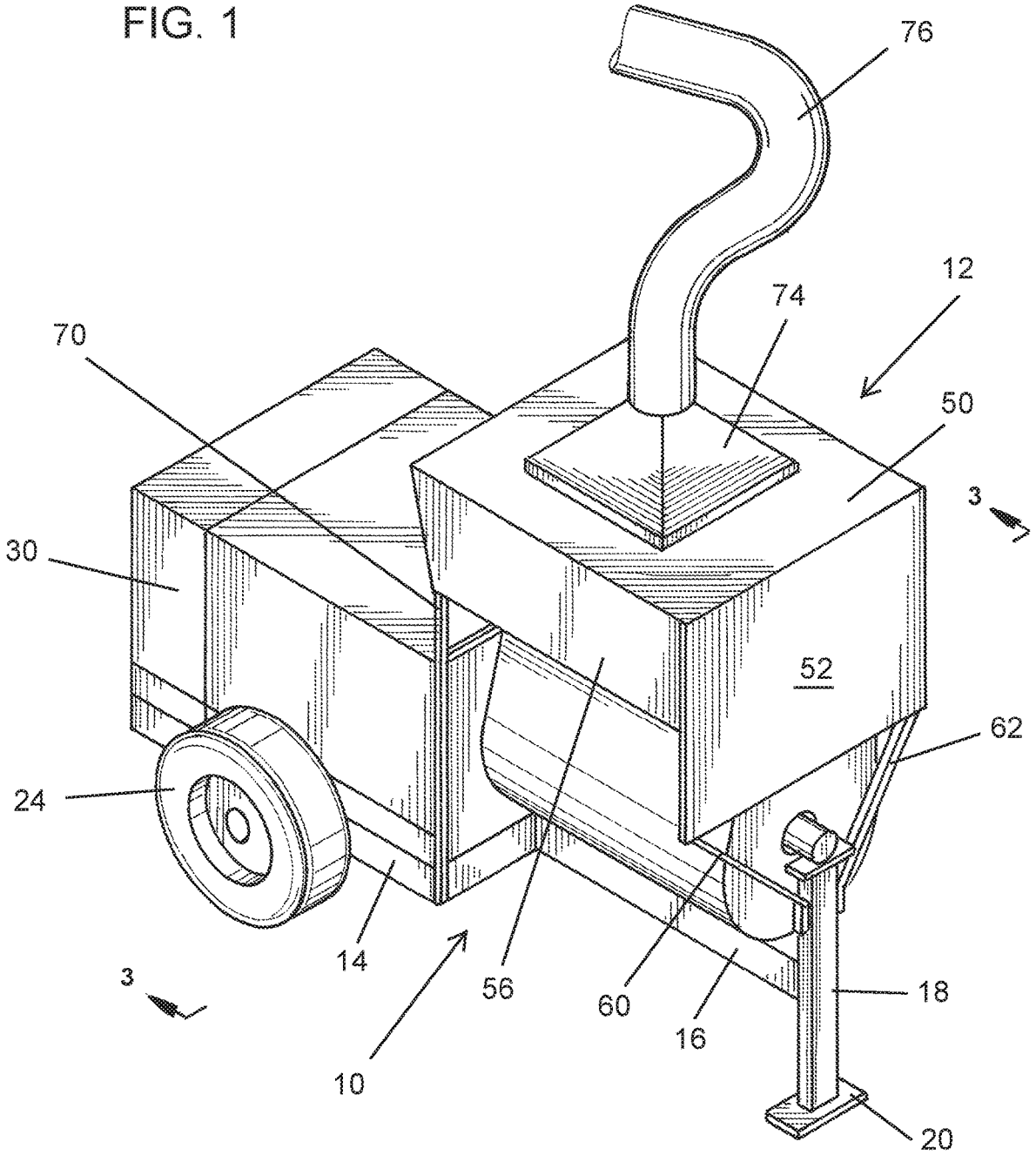
FIG. 1 is a perspective view of a mortar mixer employing one embodiment of the dust mitigation system of the present invention.

Referring now to FIG. 1, there is shown a mortar mixer, shown generally as 10, is equipped with a hood assembly, shown generally as 12 in accordance with one embodiment of the present invention. Mortar mixer 10 has a rectangular frame 14 from which extends a cross-piece 16, cross-piece 16 being connected to a stanchion 18 having a foot pad 20. Mixer 10 is provided with a wheel assembly, shown generally as 22, comprising first and second wheels 24 and 26 rotatably mounted on an axle 28 affixed to the rectangular frame portion 14. There is a motor box 30 which houses a motor and other controls necessary to operate mixer 10.

Figure 2:
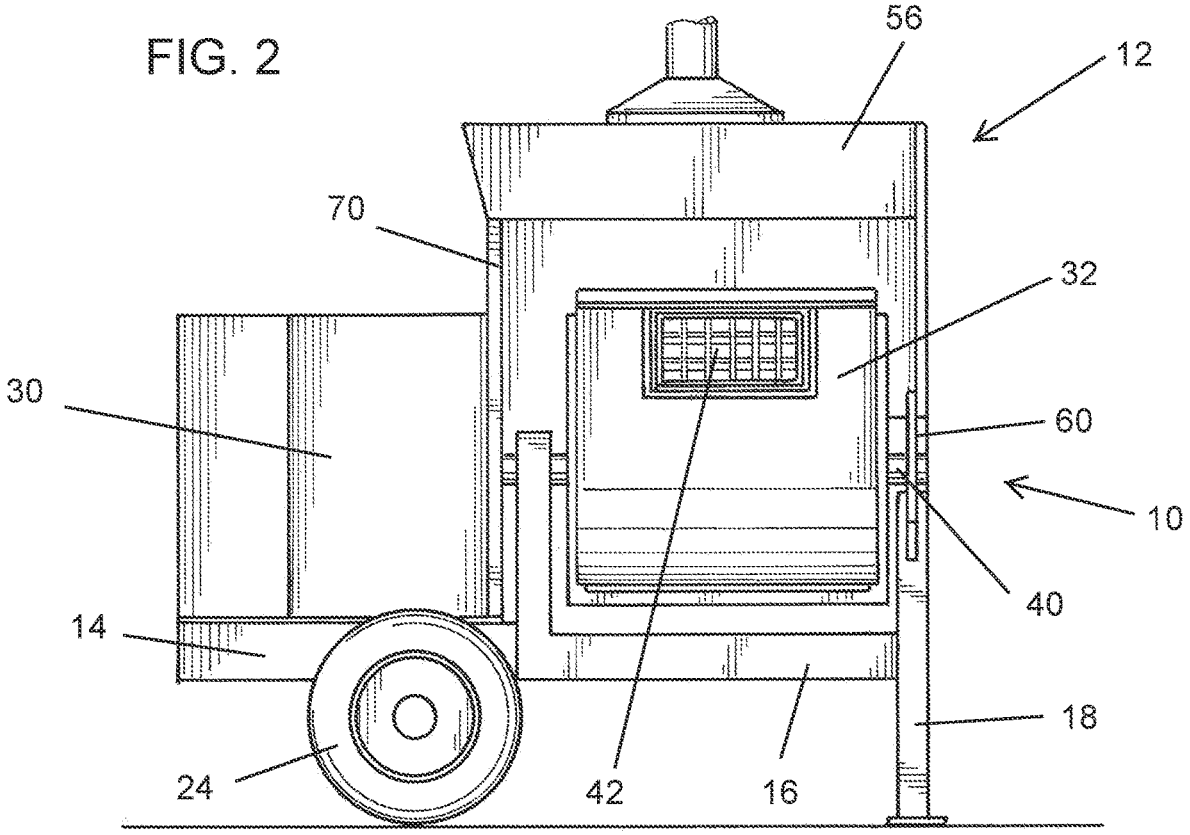
FIG. 2 is a side, elevational view of the embodiment shown in FIG. 1.
Figure 3:
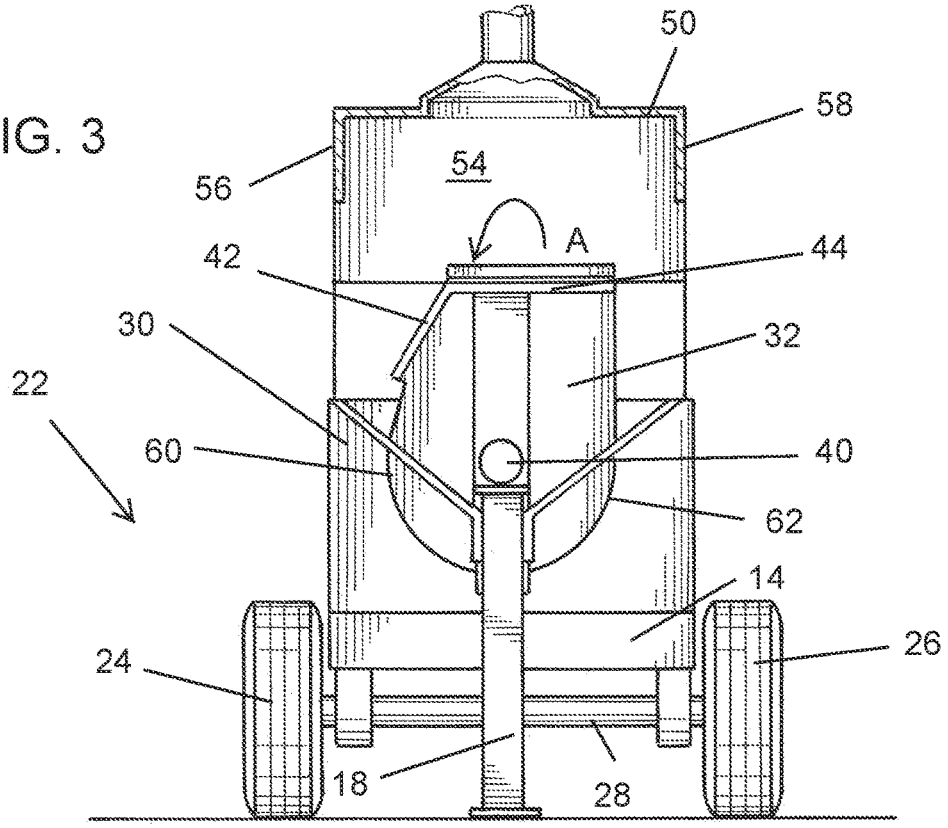
FIG. 3 is a view taken along the lines 3-3 of FIG. 1.

Mixer 10 further comprises a manually rotatable mixing drum 32 which, as shown in the drawings, is in a mixing position. As seen with reference to FIG. 3, a shaft 40 extends through drum 32 and is in turn connected to a motor contained in motor box 30. Shaft 40 is connected to a mixing paddle assembly of drum 32. Mixing drum 32 has an entrance overlaid by a grate 44. It will be appreciated by those skilled in the art that when mixer 10 is being loaded, drum 32 will be rotated in the direction of arrow A until grate 44 and hence the entrance into drum 32 is displaced about 60° from the location shown in FIG. 3. In this position, grate 44 and the entrance there below will be positioned such that a worker could throw a sack of material to be mixed onto grate 44 and hence through the entrance into the drum 32. Once loaded, drum 32 would again be rotated back to the position shown in FIGS. 1-3 and the mixing process conducted. Again, as is well known to those skilled in the art, grate 44 covers an opening in drum 32 through which mixed material passes when drum 32 is rotated in the direction of arrow A whereby it can be loaded into a suitable carrier for transport to the work site.

As best seen in FIG. 1, hood assembly 12 comprises a generally open box-like structure having a top wall 50, a front wall 56, a back wall 58, first side wall 52, and second side wall 54. As seen in FIG. 1, front wall 56 is at a slight acute angle to top wall 50. Hood assembly 12 further includes a pair of struts 60 and 62 connected to the bottom end of side wall 52 and secured, as by welding or bolts, to stanchion 18. Post 70 and a corresponding post not shown extend from the lower end of side wall 54 and are attached at their lower end to frame 14. Thus it can be seen that hood assembly 12 is securely mounted to mixer 10. It should be noted that hood assembly 12 can be fixedly or removably connected and in a preferred case it is removably secured, e.g., by the use of nuts and bolts, etc.

There is a vent 74 on top wall 50 of hood assembly 12, vent 74 being connected to a duct 76 which, although not shown, but as well understood by those skilled in the art, is connected to a vacuum/filtration apparatus, whereby airborne particles generated in the loading and mixing of mixer 10 are drawn through hood assembly 12, vent 74, and duct 76 into the vacuum/filtration apparatus.

Figure 4:
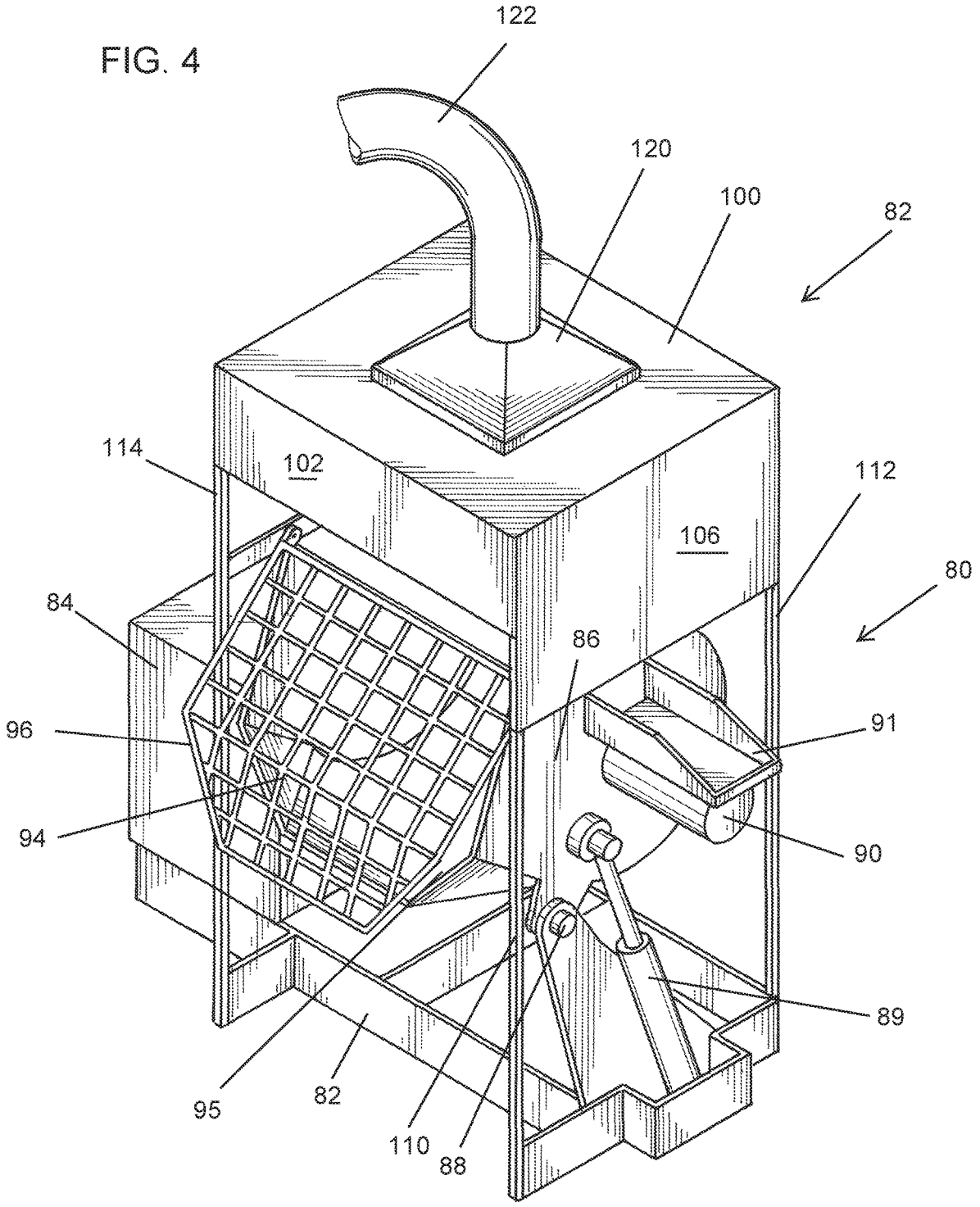
FIG. 4 is a perspective view of a mixer employing another embodiment of the dust mitigation system of the present invention.
Figure 5:
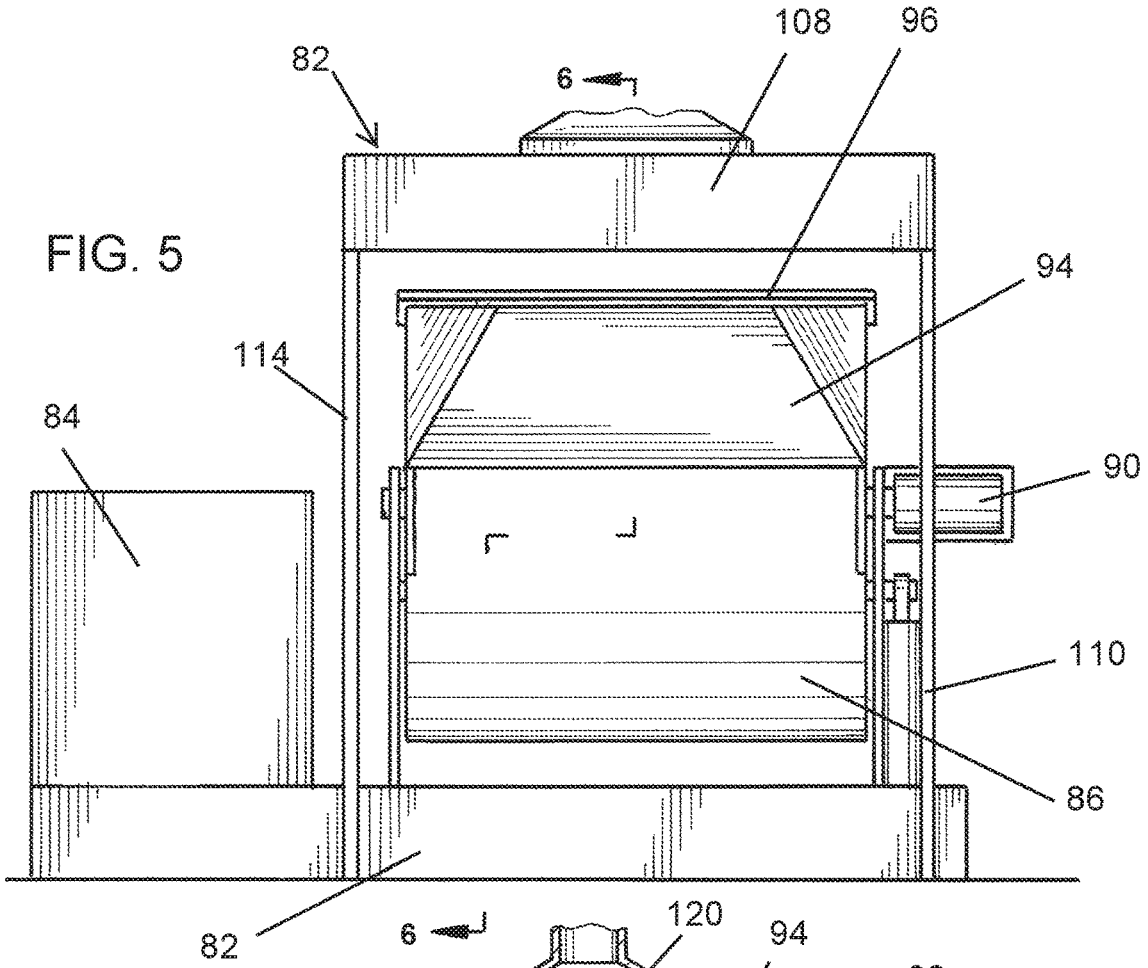
FIG. 5 is a side, elevational view of the mixer shown in FIG. 4.
Figure 6:
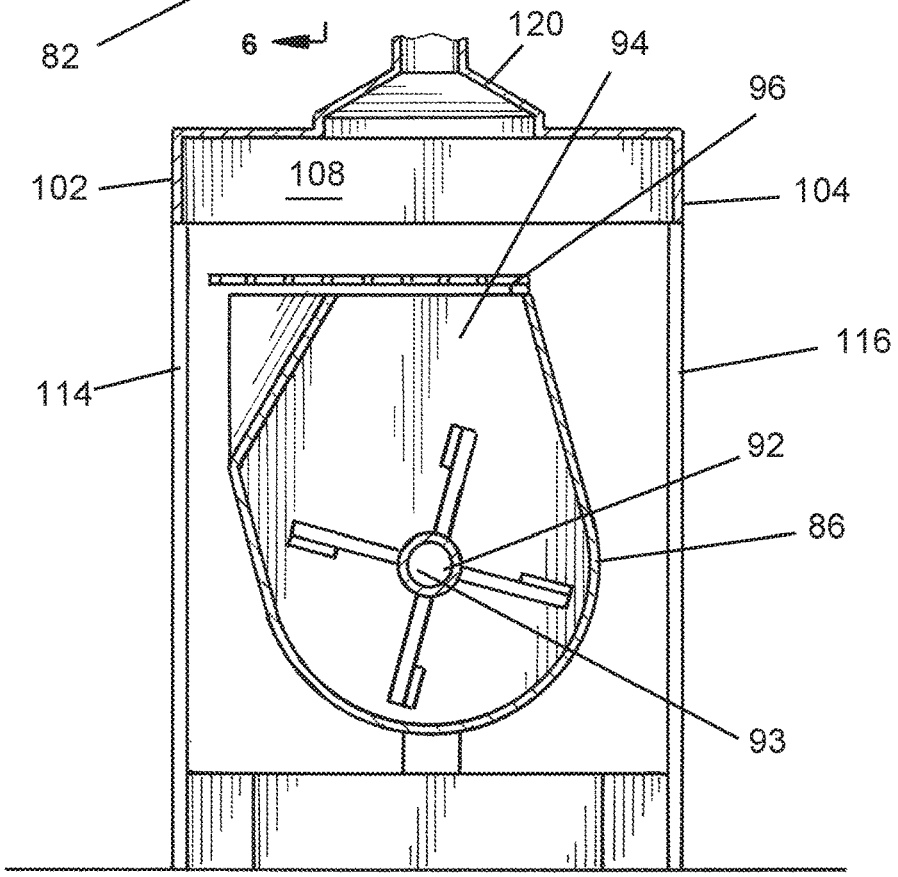
FIG. 6 is a view taken along the lines 6-6 of FIG. 5.

Referring now to FIGS. 4-6, there is shown another embodiment of the present invention in connection with a mixer which can be used for a variety of purposes including mixing mortar, grout, and other such materials. The mixer, shown generally as 80, comprises a base 82, a motor box 84, and a mixing drum 86. Mixing drum 86 can pivot about spaced pivot assemblies on either side of drum 86 only one of which, 88, is shown. Paddle mixer 92 mounted on shaft 93 is driven by hydraulic motor 90 suspended form bracket 91 and which is drivingly connected to chute 95.

Mixing drum 86 has a mouth 94 formed in part by a shaft 93. Overlying mouth 94 is a grate 96.

In the position shown in FIG. 4, hydraulic piston cylinder assembly 89 has pivoted drum 86 such that mouth 94 faces generally laterally outwardly. Accordingly, the materials to be mixed can be introduced to mouth 94 through grate 96 into mixing drum 86. Once the necessary materials have been added, the hydraulic piston cylinder assembly 89 can pivot drum 86 to a position shown in FIGS. 5 and 6. In this position, grate 96 will be substantially horizontal. Once the materials have been mixed to the desired amount, drum 86 can then be pivoted again to the position shown in FIG. 4, whereupon the mixed material will fall through the chute 95 into a suitable receptacle.

Hood assembly 82, which can be fixedly or removably attached to mixer 80 comprises a boxlike structure having a top wall 100, front wall 102, back wall 104, first end 1 wall 106, and second end wall 108. The hood assembly 82, as noted above, can be rigidly or removably attached to the frame 82 of mixer 80. In this regard, vertical supports 110, 112, 114, and 116 are connected to the four corners of the box-like structure formed by the side walls and the end walls and extend downwardly, the lower ends of the vertical supports 110-116 being connected to the frame 82. As in the other cases described above, the hood assembly and/or components thereof can be releasably attached to mixer 80. A vent 120 is connected to top wall 100 of hood assembly 82 and in turn is connected to a flexible vent hose 122 which is connected to a vacuum/filtration apparatus not shown, but well understood by those skilled in the art.

Figure 7:
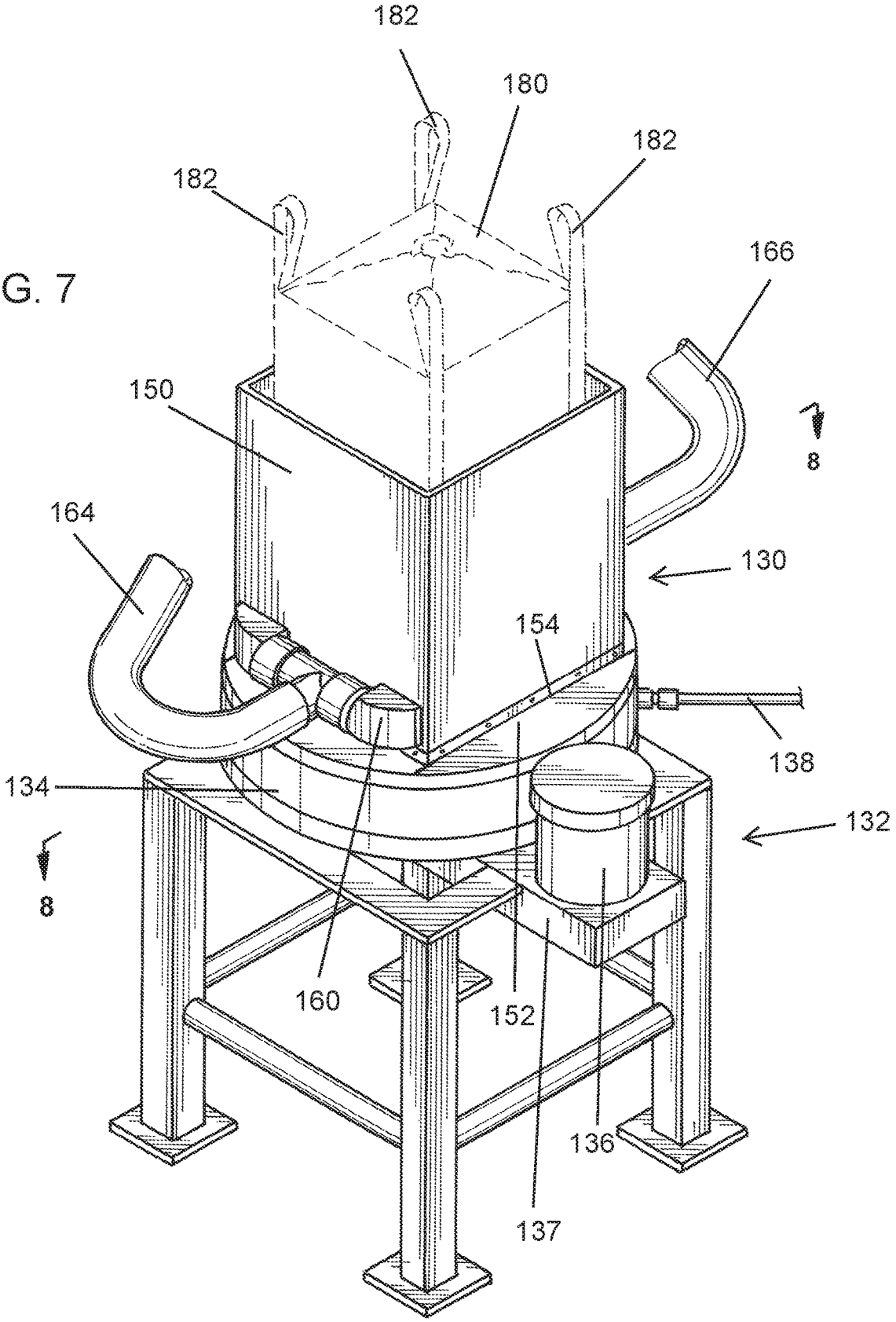
FIG. 7 is a perspective view of a batch mixer employing another embodiment of the dust mitigation system of the present invention.
Figure 8:
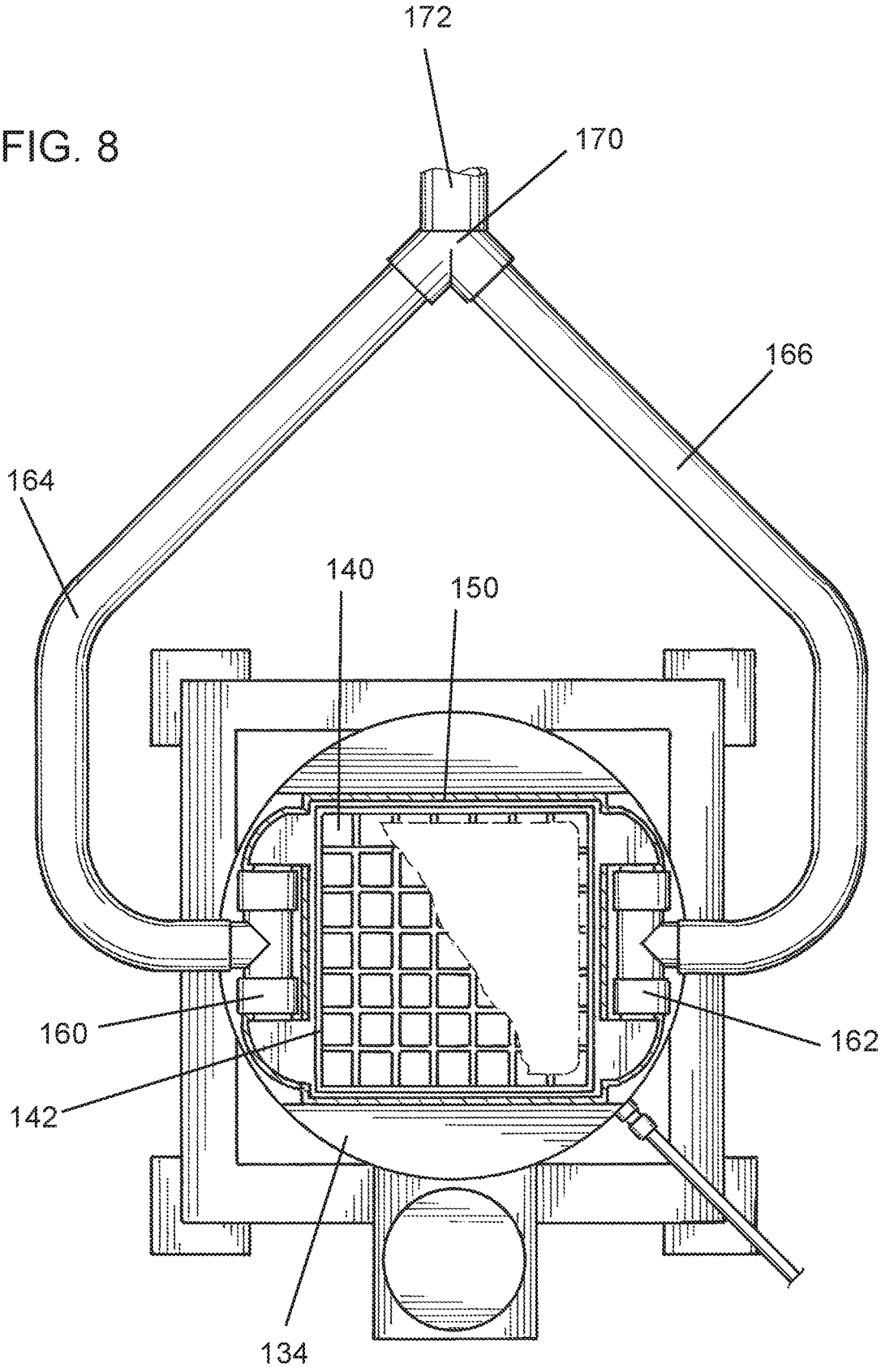
FIG. 8 is a view taken along the lines 8-8 of FIG. 7.

Referring now to FIGS. 7 and 8, there is shown another embodiment of the dust mitigation system of the present invention for use with a typical batch mixer shown generally as 130. Batch mixer 130 has a generally cylindrical mixing housing 134 in which is contained rotating paddles (not shown) driven by a belt or chain (not shown) connected to a motor 136 mounted on a motor mount 137. A hose 138 can be used to inject water or other liquid additives into the mixer housing 134. As best seen in FIG. 8, the cylindrical mixing housing 134 has a top entrance 140, a grate 142 overlying entrance 140. In point of fact, FIG. 8 substantially depicts a batch mixer without the mitigation system of the present invention, and in this regard it will be appreciated that the materials to be mixed would simply be lifted by a worker onto the grate 142, the bags being cut open and the granulated material falling into the mixing chamber formed by cylindrical mixing housing 134.

Referring now to FIGS. 7 and 8, the dust mitigation system used with the batch mixer comprises a generally rectangular chute 150 which can be removably attached to the top wall 152 of mixing housing 134. In this regard, note that rivets or bolts 154 can be used to affix chute 150 to the housing 134. Returning now to FIG. 8, there are suction plenums 160 and 162 connected to the bottom wall of chute 150 such that they are adjacent entrance 140 and grate 142. Each of the suction plenums 160, 162 is attached to a conduit 164, 166, respectively, conduits 164, 166 being connected to a Y-coupling 170 having a leg 172 which is connected to a vacuum/filtration apparatus not shown but to those skilled in the art.

In operation, the bag of material to be mixed shown in phantom as 180 is positioned in chute 150. To this end, flexible eye hooks 182 can be engaged by forklift tines, or other suitable lifting apparatus, and lowered into chute 150. As the contents of bag 180 fall out of the bottom of bag 180 into mixing housing 134 through grate 142, any dust generated is sucked into vacuum plenums 160 and 162 and transferred to the vacuum/filtration system of any various types well known to those skilled in the art.

It will be apparent from the above description and the drawings that the dust mitigation system of the present invention is both versatile and efficient. It is versatile in the sense that it can be retrofitted to existing mixers of various types as demonstrated above. Furthermore, it is efficient in the sense that it is connected to the various mixers in such a way that optimum removal of airborne dust is achieved. In this regard, as the bags of materials are opened and introduced into the various mixers, airborne dust generated in that step is almost immediately drawn by the hood through the conduits to the vacuum/filtration apparatus.

Although specific embodiments of the invention have been described herein in some detail, this has been done solely for the purposes of explaining the various aspects of the invention, and is not intended to limit the scope of the invention as defined in the claims which follow. Those skilled in the art will understand that the embodiment shown and described is exemplary, and various other substitutions, alterations and modifications, including but not limited to those design alternatives specifically discussed herein, may be made in the practice of the invention without departing from its scope.

What is claimed is:

1. A system for capturing airborne particles from a mixing apparatus for mixing mineral based building materials, the apparatus having a frame, a mixing chamber, and an inlet for introducing a granulated mineral based material into said chamber, the system comprising:

a hood assembly comprising a generally open, rigid, metallic boxlike structure forming a plenum defined by a top wall, first and second side walls, and front and back walls, said front wall, and said back wall extending downwardly from said top wall, said hood assembly being positioned adjacent said inlet and said hood assembly including first and second struts connected to the bottom end of the first side wall thereby rigidly connect said boxlike structure to said frame of said mixing apparatus, wherein said front wall is upwardly spaced from said inlet to provide open access to said inlet such that said granulated material can be introduced into said inlet and a vent duct attached to said top wall, said vent duct being adapted to be connected to vacuum/filtration apparatus.

2. The system of claim 1, wherein said vent is connected to a hose.

3. The system of claim 1, wherein said hood assembly is removably attachable to said mixing apparatus.

4. A system for capturing airborne particles from a mixing apparatus for mixing mineral based building materials, the apparatus having a mixing chamber with an inlet into said mixing chamber, said system comprising:

a chute adapted to be attached to and extend upwardly from said inlet to said mixing chamber, said chute having an open upper mouth, a first side wall, and a second opposed side wall;

a first structure forming a first suction plenum positionable in said first side wall adjacent the lower end thereof adjacent said inlet to said mixing chamber, and a second structure forming a second suction plenum positionable in said second side wall adjacent the lower end thereof and adjacent said inlet to said mixing chamber, a first vent duct having a first end connectable to said first suction plenum and a second end adapted to be connected to a vacuum/filtration apparatus, a second vent duct having a first end connectable to said second suction plenum and a second end adapted to be connected to a vacuum/filtration apparatus.

5. The system of claim 4, wherein said first and second vent ducts are connectable to a Y coupling, said Y coupling being connectable to said vacuum/filtration apparatus.

6. The system of claim 4, wherein said first and second structures have a generally tubular central section.

* * * * *